United States Patent [19]

Johannes et al.

[11] 4,190,292

[45] Feb. 26, 1980

[54] PROCESS FOR SUPPRESSING DUST IN MINES

[75] Inventors: Harald Johannes, Duesseldorf; Günther Seifert, Cologne; Hans Lewer, Witten-Annen; Dieter Poller, Dortmund, all of Fed. Rep. of Germany

[73] Assignee: Chemische Fabrik Kalk GmbH, Cologne, Fed. Rep. of Germany

[21] Appl. No.: 895,449

[22] Filed: Apr. 11, 1978

[30] Foreign Application Priority Data

| | | | |
|---|---|---|---|
| Nov. 5, 1976 | [DE] | Fed. Rep. of Germany | 2650675 |
| Apr. 1, 1977 | [DE] | Fed. Rep. of Germany | 2714569 |
| Sep. 8, 1977 | [DE] | Fed. Rep. of Germany | 2740447 |
| Oct. 13, 1977 | [DE] | Fed. Rep. of Germany | 2746005 |

[51] Int. Cl.[2] ..... E21D 23/00

[52] U.S. Cl. ..... 299/12; 299/33; 405/296

[58] Field of Search ..... 405/291, 290, 292, 296, 405/293, 294, 299, 300, 301; 61/45 D; 299/11, 12, 33

[56] References Cited

U.S. PATENT DOCUMENTS

| | | | |
|---|---|---|---|
| 4,052,860 | 10/1977 | Alterman | 299/11 |

FOREIGN PATENT DOCUMENTS

| | | | |
|---|---|---|---|
| 2257830 | 6/1974 | Fed. Rep. of Germany | 405/296 |
| 2426220 | 12/1975 | Fed. Rep. of Germany | 299/12 |
| 1414256 | 11/1975 | United Kingdom | 405/296 |

*Primary Examiner*—William F. Pate, III

*Attorney, Agent, or Firm*—Millen & White

[57] ABSTRACT

The generation of dust in a longwall mining operation is suppressed by covering the hanging wall of the mine with a plastic sheeting, the sheeting being pinned against the hanging wall by the support units used in the mine and being held in association the support units in the form of a flat package formed by folding the sheeting in a zigzag fashion along its entire length.

24 Claims, 1 Drawing Figure

PROCESS FOR SUPPRESSING DUST IN MINES

BACKGROUND

This invention relates to the suppression of dust in the coal mining industry, and, more particularly, in mines wherein powered support units are utilized.

The dust suppression in the mines of the hard coal mining industry which use powered supports is burdened with difficulties. For example, in addition to the dust that is normally generated during mining operations, which can be considerably reduced by means of the well known soaking or jet blasting of the coal face, further amounts of dust are generated by the use of the support units themselves. This is caused, on the one hand, by the crushing of the lowest strata of the hanging wall or ceilings due to the high pressure of the support shields, and, furthermore, by the breaking down of the backfilling as the support shields advance.

One process for reducing the dust generated in powered advancing longwall mining, is to cover the hanging wall with plastic sheeting. In this process, the sheets are applied with the aid of the extraction or mining equipment and are pressed against the hanging wall with the aid of the mine supports. It is customary, in this regard, to arrange the sheets in the form of rolls placed in mounts attached to the support units so that as the extraction units advance, the sheets unroll. However, the mounts which are attached to the support units and which contain the sheet rolls are relatively bulky, resulting in a considerable disadvantage when dealing with seams of limited richness or thickness.

SUMMARY OF THE INVENTION

Accordingly, it is an object of the invention to provide an improved process for reducing dust in coal mines using powered supports.

It is another object to provide a process for covering the hanging walls of a coal mine with sheeting of dust impervious material, wherein power supports are used in advancing longwall mining.

These and other objects and advantages inherent in and encompassed by the invention will become apparent to those skilled in the art upon reading the following description of a preferred embodiment of the invention, when taken in conjunction with the accompanying drawing.

BRIEF DESCRIPTION OF A PREFERRED EMBODIMENT

Figure 1:
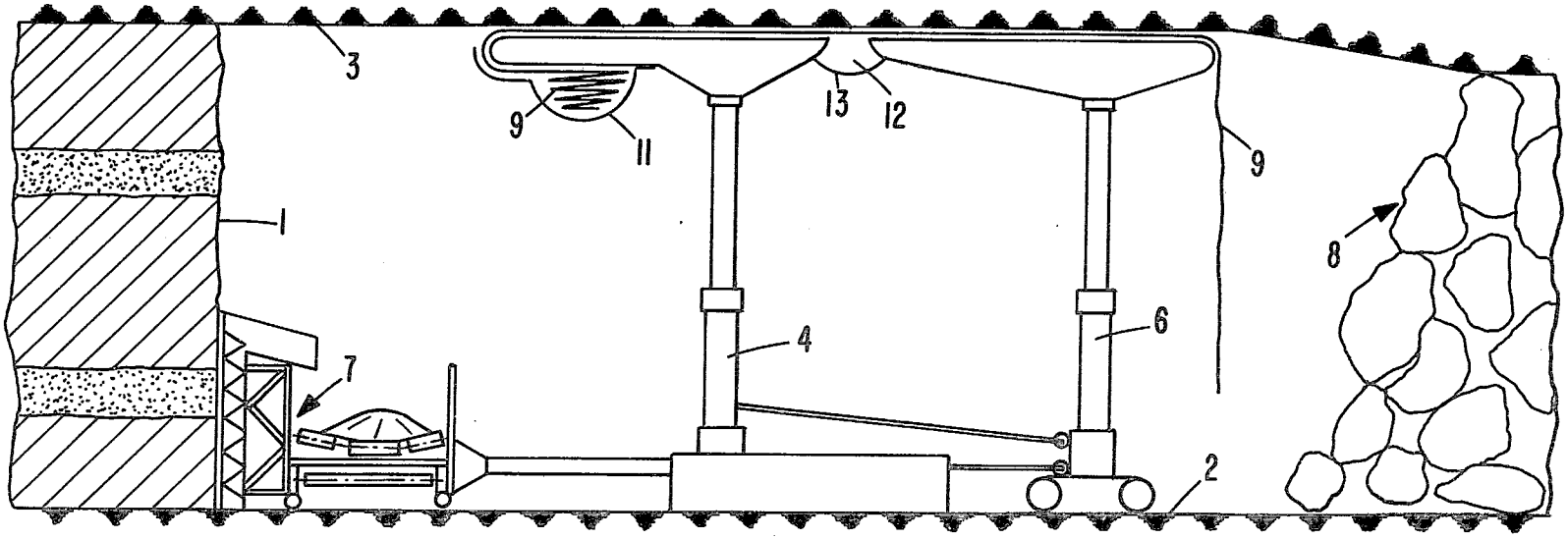
FIG. 1 is a schematic elevational view, partially in section, illustrating one manner in which sheeting of dust impervious material may be applied against the hanging wall of a long wall mine by the powered supports used therein.

Referring to the drawing, there is illustrated a longwall mine, which is defined by a coal face 1, a floor or bottom wall 2, and a ceiling or hanging wall 3. Within the mine, there are disposed a pair of conventional advanceable powered support units having support posts or struts 4, 6 which extend between the mine floor and ceiling to support the tunnel against collapse. On the forward-most support unit is mounted a coal extraction machine 7, such as a roller coal auger loader. The coal extraction machine can be adapted to advance against the coal face simultaneously with the support units in a manner which is well known in the art and which does not, in and of itself, form a part of this invention. Also illustrated in the drawing are the back-filling 8 formed by the breaking down of the hanging wall 3 as the support units advance, the dust impervious sheeting 9 which is used to cover the hanging wall 2 to reduce the amount of dust in the mine, and a holding device or receptable 11 for the dust impervious sheeting.

With further reference to the drawing, the process of the present invention is characterized by the fact that the sheeting 9 is provided with a longitudinal fold along its entire length, is folded in a zigzag fashion, and is reduced to a substantially flat package in the receptacle 11 with a width of perferable 0.6 to 1.0 m. The receptacle 11 containing the flat package is mounted at the face side of a support unit whereupon the free longitudinal edge of a given package is firmly connected with the jutted-out end of the already underpinned sheeting material of the preceding packing.

The sheeting material, which in this mode of operation, runs parallel with the extraction front, is provided with a width that corresponds to the extraction progress of one coal-getting shift. That is, roughly 4 to 5 meters. The length of the sheet material is measured to correspond to the section or cut of one coal getting shift; thus, approximately 20 to 30 meters. In this fashion, one package of sheeting is required for each shift.

A wide variety of dust impervious or substantially dust impervious materials are suitable for use as the sheeting material herein. However, the use of a plastic material such as polyethylene sheeting is preferred. Suitable polyethylene sheeting materials include those having a thickness of about 0.5 mm in the form of flat sheets or in the form of tubular sheets. In this regard, it is advantageous if the sheets are made flame resistant in the conventional manner, for example, by adding chloroparaffins or by adding highly bromated aromatic hydrocarbons. In special cases, particularly in mines threatened by explosive atmospheres (foul pits), the sheets can be provided, additionally, with an antistatic finish; for example, by providing a graphite paste layer.

Regardless of the sheet material selected for use, the sheets are folded, persuant to this invention, in zigzag, accordion-like fashion along their length to a width of 0.6 to 1.0 meter. For purposes of transport, the folded sheets can be configured as a 1 meter long package by means of a transverse fold. This transverse flatening can also be done in a zigzag fashion. The sheets, folded in this manner, can be transported to the place of application where the transverse fold is again pulled apart so that an extended folded package is again on hand. This package is then inserted into a holding device 11, for example, a simple spring U-bolt, mounted below the cappers of the face side of the support unit. For start-up operations, the free longitudinal edge of the newly inserted sheet material is then pulled out and placed between the support unit and the hanging wall. However, when a new package is being used to continue an existing operation, the free longitudinal edge is pulled out and firmly tied or connected to the jutted-out end of the sheet that was extended in the previous shift and which is already underpinned by the support unit. The jount between the two sheets can be glued or welded. As the supports advance persuant to the mining progress, the sheets are unfolded from the package supply and they continue to be underpinned. In this manner, a continuous covering of the hanging wall is effected which makes it possible to protect nearly completely against dust stemming from the hanging wall stratum. Of course, relatively large quantities of sheeting are required.

It is possible, however, in some cases, to merely cover the gap 12 between two support units by means of one sheeting strip 13. In that case, the sheeting strips will run perpendicular to the extraction front.

A gap can form between the sheets, for example, when lowering the protective supports during the mining advance. To avoid having the dust which has collected on the sheets from being blown through this gap and into the mine proper, the invention provides that also during the advance of the support units along the hanging wall stratum, the cappers trail and also underpin the sheet along the extraction face side and thus press the sheet against the hanging wall. By means of this trailing and dragging advance of the cappers, further loosening of the lower hanging wall stratum layers, which would otherwise occur as result of lowering and renewed moveout of the cappers, is avoided. However, special demands are made on the mechanical characteristics of the sheeting material to be used in this mode, i.e., on the tensile strength, tearing strength, and stretching capability thereof, as a result of the enormous tensile stresses that are encountered. The sheets must also be able to align without tearing along irregular hanging wall strata that are uneven and have protrusions. During the sequential or alternate advancement of the support units, one portion of the sheeting remains underpinned, whereas another portion is stretched. The sheeting must be able to absorb this strain too, without tearing. Sheets made of polypropylene, polyisobutylene or polyvinylchloride, and especially polyethylene, having a thickness of from about 0.2 to 0.5 mm are suited for this purpose. The tearing strength of these sheets should be at least about 15 $N/mm^2$, and the tearing stretch should be at least 4 m/m or 400%.

Sheets of the required thickness are not always available. For this reason, the invention provides for an alternative embodiment which uses, in place of a foil of 0.2 to 0.5 mm, two or three sheets that rest parallel over one another, each sheet having a thickness of 0.075 to 0.3 mm.

Such multilayer sheets can be applied in various ways. Since plastic sheets are frequently manufactured in form of tubular sheets, the simplest application calls for the use of such tube sheets as double sheets. Since, however, the two layered tubular sheets can only be shifted relative to each other by very small amounts, it is recommended that the tubular sheet be cut open along one or both longitudinal sides prior to being unfolded. This provides for a considerably larger play between the two sheet layers.

A further embodiment consists of the application of two separate flat sheets in unison, so that, in accordance with this invention, they rest parallel and on top of each other. The two sheets can be placed as a dual sheet on a common roll or in a common folded package. It appears especially advantageous however, for each sheet to have its own roll or to unfold from its own flat package which can be attached, for example, one on the left and one on the right of the support unit whose interval is to be covered by the double sheeting. This type of mounting and attachment makes it possible to extract from the supply package, sheets of different length depending on the existing requirements. Such an arrangement thus makes it much easier to compensate for any shifting in the upper and lower of the two sheeting layers.

Still another embodiment comprises the use of triple layer of still thinner sheets in place of the dual sheeting. This makes it possible to apply thick layers of sheet at a stratum even if sheet material of lesser thickness is available. In addition, a triple layer makes for still better shifting of the sheets relative to each other.

Generally, the coefficient of friction between plastic sheets, especially in case of polyethylene sheets, is very low. Should the natural sliding ability of the sheets relative to each other be insufficient, it is possible to increase the sliding performance by means of suitable lubricant. Such lubricants can be finely granulated solids such as talcum or even liquids; in the simplest case, just plain water.

Under operational conditions even when the best care is taken, it is not always possible to avoid the dust which has collected on top of the sheets from occasionally entering the shored up area. For example, when the struts are inadvertently removed or when sheeting layers suddenly tear. In these cases, a trickling down or drifting of the dust from the sheet can be prevented by providing the covering sheets with from about 10 to 20 $g/m^2$ of a solid, finely granulated hygroscopic salt, such as calcium chloride and/or magnesium chloride which, if necessary, can contain small quantities of a wetting agent. The finely granulated hygroscopic salt should be distributed on the sheet substantially uniformly, and in the conventional manner, should be pressed against the hanging wall stratum so that the layer of hygroscopic salt exists between the sheet and the stratum.

In this manner, the entire dust that is generated at the hanging wall's surface is fixed, can not rise, and is collected on the sheeting. The dust thus collected amounts, at most, to approximately 100 $g/m^2$. However, the quantity is usually much smaller. Since the hygroscopic salt deliquesces rapidly and can then fix dust as much as five or eight times its own weight, 10 to 20 $g/m^2$ of this salt can easily arrest the dust that is encountered.

It is not absolutely necessary to provide the salt powder with a wetting agent. However, the addition of the wetting agent can be advantageous as it assures a more rapid soaking of the dust. Also the creeping characteristic of the solution resulting from this powder is enhanced by the addition of a wetting agent. The solution creeps into the cracks of the hanging wall stratum which contains the dust. In such cases, alkylphenylglycol ethers have proved to be an especially suitable wetting agent. Preferably, the wetting agent is used in quantities of from about 1 to 3 per 100 g of salt powder.

The application of the powder can be done manually or by means of machines. When relatively short mining fronts are involved, and thus correspondingly shorter sheet lengths of plastic are required, the powder can be applied most simply by scattering the powder on the stretched sheet before it is pressed against the hanging wall stratum. When, as in cases of longer fronts, the sheets are applied from rolls or from flat packages mounted below the support units, then the finely granulated powder can be applied by means of a suitable apparatus which may be attached to the support units. For example, it can be deposited by blowing a mixture of salt and compressed air into the space between the unrolling or unfolding sheeting and the hanging wall stratum.

The process of the present invention allows for a very considerable reduction of the dust encountered in advancing longwall mining. For this purpose, the hanging wall stratum is continuously covered with long plastic sheets which run parallel to the extraction face side. Despite their enormous size, the invention allows for a simple manipulation of these sheets which can be applied, without difficulty, by means of the support units. A variation of the invention makes it possible to use a number of smaller sheet lengths which run perpendicular to the mining front and which cover the gap between two support units. Even the noncontinuous covering of the hanging wall stratum, which yields a saving in respect to sheeting material, still acts as a good dust protector. For example, in a mine where fat coal was extracted by means of a roller coal auger loader, the dust load was 0.5 mg quartz fine dust and 6 mg fine dust per $m^3$, despite soaking and jetting of the extraction machine. By introducing a series of polyethylene sheets of 25 m length, 1.20 m width and 15 mm thickness, the dust load was reduced to 0.1 mg quarts fine dust and 4 mg fine dust per $m^3$.

A further advantage of the process covered by this invention is the protection against matte fall resulting from covering the hanging wall stratum. Finally, the support units themselves are protected against excessive dust development by means of the sheet covering, so that they become less susceptible to breakdown.

Other features of this invention not specifically enumerated herein will undoubtedly occur to those versed in the art, as likewise, will numerous modifications and alterations in the preferred embodiment of the invention, all of which may be achieved without departing from the spirit and scope thereof.

What is claimed is:

1. A process for suppressing dust in a longwall mining operation, wherein advanceable support units are used to support the hanging walls of the mine while mining operations are being carried out on the face of the mine, which comprises:

advancing a leading edge of a sheet of dust impervious material, folded in a zigzag fashion, from a package of said sheet material mounted on an advanceable support unit positioned adjacent the mine face;

feeding said leading edge of said sheet between the support unit and a first portion of the hanging wall of the mine such that said sheet is unfolded and withdrawn from said package and temporarily pinned against the first portion of the hanging wall by the support unit;

advancing the support unit toward the mine face while maintaining said sheet material pinned against the first portion of the hanging wall, whereby an additional length of said sheet material is unfolded and withdrawn from said package and is temporarily pinned against a second portion of the hanging wall; and repeating the foregoing steps, thereby pinning a further length of said sheet material to a third portion of the hanging wall, and releasing the portion of the sheet material pinned against said first portion of the hanging wall.

2. A process for suppressing dust in a longwall mining operation, wherein advanceable support units are used to support the hanging walls of the mine while mining operations are being carried out on the face of the mine, which comprises:

mounting to an advanceable support unit a substantially flat package of dust impervious sheeting material formed by folding an elongated sheet of said material in a zigzag fashion along its entire length;

advancing a leading edge of said sheet material from said flat package;

feeding said leading edge of said sheet material between the support unit and a first portion of the hanging wall of the mine such that said sheet material is unfolded from said package and pinned against the first portion of the hanging wall by the support unit; and advancing the support unit toward the face of the mine during the mining operation while maintaining said sheet material pinned against the first portion of the hanging wall, whereby additional lengths of said sheet material are unfolded and withdrawn from said flat package and are pinned against additional portions of the hanging wall to prevent any dust from falling therefrom.

3. The process of claim 2, wherein two support units are employed, one unit being closer to the mine face and the second unit trailing the first unit so as to define a gap between the two units and which further comprises:

securing a length of dust impervious sheeting material across the gap between the two support units.

4. The process of claim 3 wherein the first and second support units advanced toward the mine face sequentially such that a first portion of the sheet material is pinned against the hanging wall while a second portion thereof is stretched.

5. The process of claim 3 wherein said sheet material is comprised of polyethylene having a thickness between about 0.2 and 0.5 mm, a tearing strength of at least 15 $N/mm^2$, and a tearing stretch of at least 400%.

6. The process of claim 4, wherein said sheet material is comprised of polyethylene having a thickness between about 0.2 and 0.5 mm, a tearing strength of at least 15 $N/mm^2$, and a tearing stretch of at least 400%.

7. The process of claim 3, wherein said sheet material is comprised of a plurality of plies each having a thickness of from about 0.075 mm to 0.3 mm.

8. The process of claim 3, wherein said sheet material is comprised of a plurality of plies each having a thickness of from about 0.075 mm to 0.3 mm.

9. The process of claim 4, wherein said sheet material is comprised of a plurality of plies each having a thickness of from about 0.075 mm to 0.3 mm.

10. The process of claim 7 further comprising the step of applying a lubricant between said plurality of plies.

11. The process of claim 8 further comprising the step of applying a lubricant between said plurality of plies.

12. The process of claim 9, further comprising the step of applying a lubricant between said plurality of plies.

13. The process of claim 2 further comprising the step of depositing about 10 to 20 $g/m^2$ of solid, finely granulated hygroscopic salt on the surface of said sheeting material which contacts the hanging wall.

14. The process of claim 3 further comprising the step of depositing about 10 to 20 $g/m^2$ of solid, finely granulated hygroscopic salt on the surface of said sheeting material which contacts the hanging wall.

15. The process of claim 4 further comprising the step of depositing about 10 to 20 $g/m^2$ of solid, finely granulated hygroscopic salt on the surface of said sheeting material which contacts the hanging wall.

16. The process of claim 5 further comprising the step of depositing about 10 to 20 $g/m^2$ of solid, finely granulated hygroscopic salt on the surface of said sheeting material which contacts the hanging wall.

17. The process of claim 7 further comprising the step of depositing about 10 to 20 g/m$^2$ of solid, finely granulated hygroscopic salt on the surface of said sheeting material which contacts the hanging wall.

18. The process of claim 13 wherein said hygroscopic salt is deposited by blowing a mixture of said salt and compressed air between the unfolding sheeting and the hanging wall.

19. The process of claim 14 wherein said hygroscopic salt is deposited by blowing a mixture of said salt and compressed air between the unfolding sheeting and the hanging wall.

20. The process of claim 15 wherein said hygroscopic salt is deposited by blowing a mixture of said salt and compressed air between the unfolding sheeting and the hanging wall.

21. The process of claim 16 wherein said hygroscopic salt is deposited by blowing a mixture of said salt and compressed air between the unfolding sheeting and the hanging wall.

22. The process of claim 17 wherein said hygroscopic salt is deposited by blowing a mixture of said salt and compressed air between the unfolding sheeting and the hanging wall.

23. The process of claim 2 wherein said flat package is mounted on said advanceable support unit proximate the surface of said hanging wall.

24. The process of claim 1 wherein said sheet material is comprised of polyethylene having a thickness between about 0.2 and 0.5 mm, a tearing strength of at least 15 N/mm$^2$, and a tearing stretch of at least 400%.

* * * * *